US009961756B2

(12) United States Patent
Askebro et al.

(10) Patent No.: US 9,961,756 B2
(45) Date of Patent: May 1, 2018

(54) ISOTOPE PRODUCTION TARGET CHAMBER INCLUDING A CAVITY FORMED FROM A SINGLE SHEET OF METAL FOIL

(71) Applicant: General Electric Company, Schenectady, NY (US)

(72) Inventors: Peter Lars-Goran Askebro, Uppsala (SE); Johan Olof Larsson, Danderyd (SE)

(73) Assignee: General Electric Company, Schenectady, NY (US)

( * ) Notice: Subject to any disclaimer, the term of this patent is extended or adjusted under 35 U.S.C. 154(b) by 721 days.

(21) Appl. No.: 14/508,689

(22) Filed: Oct. 7, 2014

(65) Prior Publication Data

US 2016/0100477 A1 Apr. 7, 2016

(51) Int. Cl.
*G21G 1/10* (2006.01)
*H05H 6/00* (2006.01)

(52) U.S. Cl.
CPC ..... *H05H 6/00* (2013.01); *G21G 1/10* (2013.01)

(58) Field of Classification Search
CPC ... H05H 6/00; G21G 1/10; G21K 5/08; B26F 1/00; B21D 35/001; B21C 37/00; B65D 41/14; B65D 77/20
USPC ..... 376/202, 190; 29/17.2, 592
See application file for complete search history.

(56) References Cited

U.S. PATENT DOCUMENTS

| | | | | |
|---|---|---|---|---|
| 3,144,974 | A * | 8/1964 | Eichner | B65D 1/34 220/575 |
| 5,521,469 | A | 5/1996 | Laisne | |
| 6,057,655 | A | 5/2000 | Jongen | |
| 6,392,246 | B1 | 5/2002 | Wiberg et al. | |
| 6,417,634 | B1 | 7/2002 | Bergstrom | |
| 6,433,495 | B1 | 8/2002 | Wiberg | |
| 7,122,966 | B2 | 10/2006 | Norling et al. | |
| 7,466,085 | B2 | 12/2008 | Nutt | |
| 7,476,883 | B2 | 1/2009 | Nutt | |
| 7,512,206 | B2 | 3/2009 | Wieland | |
| 7,831,009 | B2 * | 11/2010 | Alvord | G21G 1/10 376/201 |
| 8,153,997 | B2 | 4/2012 | Norling et al. | |
| 8,288,736 | B2 * | 10/2012 | Amelia | G21G 1/10 376/195 |
| 2005/0283199 | A1 | 12/2005 | Norling et al. | |
| 2007/0036259 | A1 * | 2/2007 | Wieland | G21G 1/10 376/195 |

(Continued)

OTHER PUBLICATIONS

Jeswiet, "Metal forming progress since 2000", CIRP Journal of Manufacturing Science and Technology 1 (2008) 2-17.*

(Continued)

*Primary Examiner* — Jack W Keith
*Assistant Examiner* — Daniel Wasil
(74) *Attorney, Agent, or Firm* — Dean D. Small; The Small Patent Law Group, LLC

(57) ABSTRACT

A target chamber and a method for manufacturing the target chamber for a radioisotope production system is provided. The target chamber includes a cavity formed from a single sheet of metal foil enclosed by a cover. The cavity configured to contain a starting liquid and receive a particle beam that is incident upon the starting liquid thereby generating radioisotopes.

20 Claims, 6 Drawing Sheets

(56) References Cited

U.S. PATENT DOCUMENTS

| | | | | |
|---|---|---|---|---|
| 2009/0052628 | A1* | 2/2009 | Wilson | G21G 1/10 378/143 |
| 2011/0255646 | A1* | 10/2011 | Eriksson | G21G 1/10 376/202 |
| 2012/0321026 | A1* | 12/2012 | Norling | G21G 1/10 376/190 |
| 2013/0169194 | A1 | 7/2013 | Larsson | |
| 2013/0259180 | A1* | 10/2013 | Norling | H05H 6/00 376/202 |
| 2017/0213614 | A1* | 7/2017 | Conard | G21G 1/10 |

OTHER PUBLICATIONS

Singer, "Preliminary Results From Multi-Cell Seamless Niobium Cavities Fabricated by Hydroforming", LINAC2008 conference, Oct. 2008.*

Siikanen, "Development of a Niobium target for routine production of [18F] fluoride with a MC 16 Scanditronix cyclotron", Lund University, 2006.*

Collard, "Pure Niobium Sheet Formability Limits Hydroforming", CEA-CONF-8418, 1986.*

"Packaging Materials for Canned Fishery Products", Manual on fish canning, sections 2.1.1 to 2.1.3, Food and Agriculture Organization of the United Nations, 2017.*

* cited by examiner

ISOTOPE PRODUCTION TARGET CHAMBER INCLUDING A CAVITY FORMED FROM A SINGLE SHEET OF METAL FOIL

BACKGROUND OF THE INVENTION

The subject matter disclosed herein relates generally to isotope production systems, and more particularly to a target chamber of the isotope production system that includes a cavity formed from sheet metal.

Radioisotopes (also called radionuclides) have several applications for medical therapy, imaging, and research, as well as other applications that are not medically related. Systems that produce radioisotopes typically include a particle accelerator that generates a particle beam. The particle accelerator directs the beam toward a target material in a target chamber. In some cases, the target material is a liquid (also referred to as a starting liquid), such as enriched water. Radioisotopes are generated through a nuclear reaction when the particle beam is incident upon the starting liquid in the target chamber.

Conventionally, the target chamber is formed by milling or machining a block of metal, such as niobium, to form a cavity to contain the starting liquid. However, the milling process is inefficient, producing waste and low manufacturing yield rates based on tolerance requirements, such as for thickness, for transferring thermal heat from the target chamber to an external system.

BRIEF DESCRIPTION OF THE INVENTION

In an embodiment, a target chamber for a radioisotope production system is provided. The target chamber includes a cavity formed from a single sheet of metal foil enclosed by a cover. The cavity configured to contain a starting liquid and receive a particle beam that is incident upon the starting liquid thereby generating radioisotopes.

Optionally, the cavity is formed by mechanically punching, hydroforming or hydraulic forming a cavity form factor into the single sheet of metal foil.

In an embodiment, a method for manufacturing a target chamber is provided. The method includes, receiving a single sheet of metal foil, and punching the single sheet of metal foil to form a cavity. The cavity is configured to contain a starting liquid and receive a particle beam that is incident upon the starting liquid thereby generating radioisotopes. The method also includes coupling a cover to a lip of the cavity to enclose the cavity.

In an embodiment an isotope production system is provided. The isotope production system includes a particle accelerator configured to produce a particle beam, a target chamber having a cavity configured to receive the particle beam. The cavity formed from a single sheet of metal foil enclosed by a cover and configured to contain a starting liquid. The cavity is located so that the particle beam is incident upon the starting liquid thereby generating radioisotopes.

DETAILED DESCRIPTION OF THE INVENTION

Figure 1:
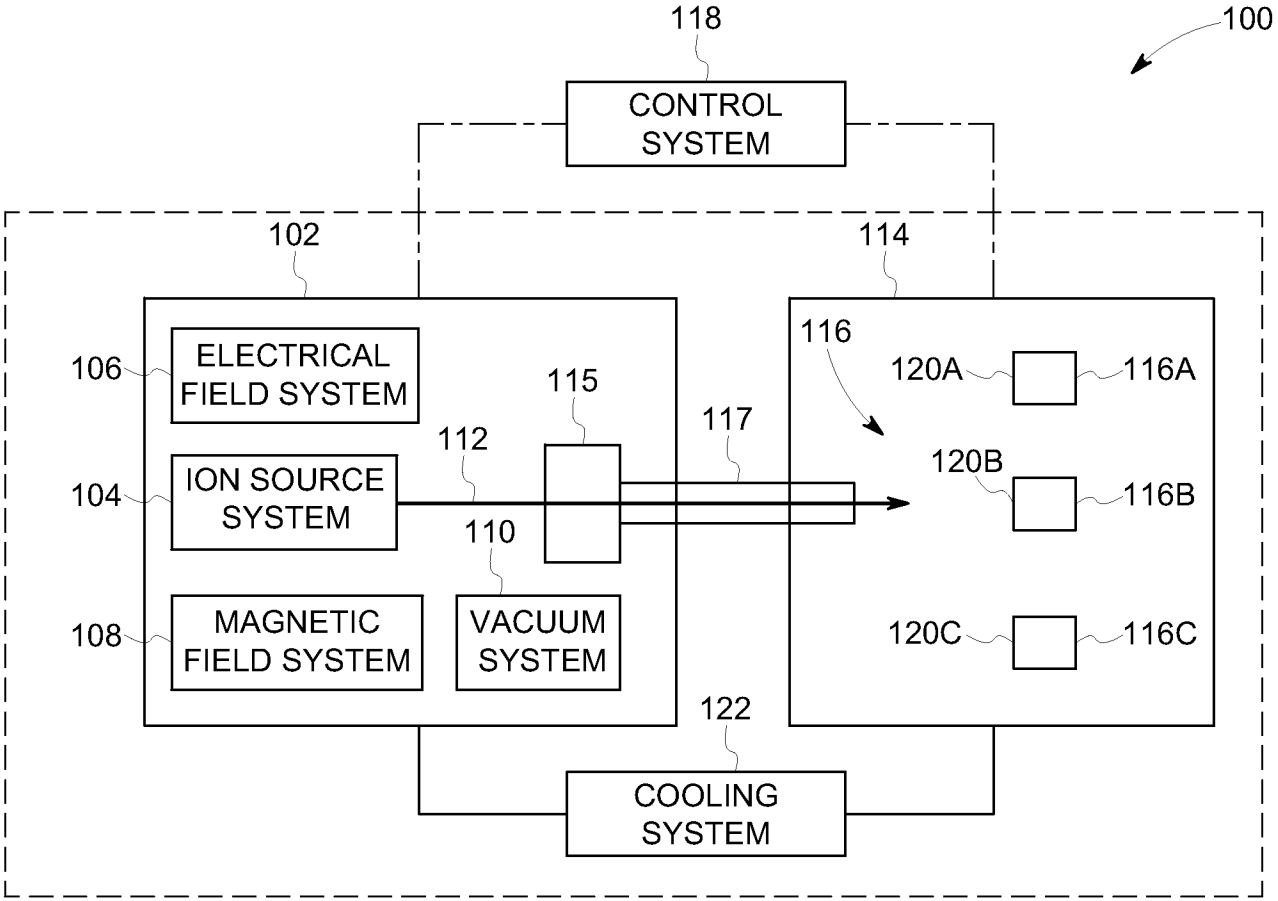
FIG. 1 is a block diagram of an isotope production system having a target apparatus formed in accordance with an embodiment.

The foregoing summary, as well as the following detailed description of certain embodiments will be better understood when read in conjunction with the appended drawings. To the extent that the figures illustrate diagrams of the blocks of various embodiments, the blocks are not necessarily indicative of the division between hardware or structures. Thus, for example, one or more of the blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated, such as by stating "only a single" element or step. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Also, as used herein, the term "fluid" generally means any flowable medium such as liquid, gas, vapor, supercritical fluid, or combinations thereof. The term "liquid" can include a liquid medium in which a gas is dissolved and/or a bubble is present. As used herein, the term "vapor" generally means any fluid that can move and expand without restriction except for a physical boundary such as a surface or wall, and thus can include a gas phase, a gas phase in combination with a liquid phase such as a droplet (e.g., steam), supercritical fluid, or the like.

Generally, various embodiments provide a target apparatus for isotope production systems that includes a cavity within a target chamber. The target chamber includes a cavity for the bombardment of a media or starting liquid (e.g., enriched $H_2{}^{18}O$ water, $^{18}O_2$ gas, enriched $H_2{}^{16}O$ water, or the like). A particle beam is bombarding the starting liquid resulting in an increase in pressure and thermal energy (e.g., heat) within the cavity. A cooling system may be coupled externally to the cavity to absorb thermal energy away from the cavity.

The cavity may be made of a thin sheet metal having a uniform thickness and/or a thickness within a predetermined tolerance. The thin sheet metal may comprise niobium, tantalum, stainless steel, aluminum, or the like. The cavity may be mechanically punched or formed (e.g., using hydroforming, using hydraulic forming) into the sheet metal. At least one technical effect of various embodiments include improved heat transfer from the cavity to the cooling system due to the thin wall thickness of the cavity. At least one technical effect of various embodiment include a reduction in waste material from forming the cavity compared to conventional methods of milling and/or machining the cavity from a metal block.

A target apparatus formed in accordance with various embodiments may be used in different types and configurations of isotope production systems. For example, FIG. 1 is a block diagram of an isotope production system 100 that includes a particle accelerator 102 (e.g., isochronous cyclotron) having several sub-systems including an ion source system 104, an electrical field system 106, a magnetic field system 108, and a vacuum system 110. When the particle accelerator 102 is a type of cyclotron, charged particles may be placed within or injected into the particle accelerator 102 through the ion source system 104. The magnetic field system 108 and electrical field system 106 generate respective fields that cooperate with one another in producing a particle beam 112 of the charged particles. Although in one embodiment the particle accelerator 102 may be a cyclotron, other embodiments may use different types of particle accelerators to provide particle beams.

Also shown in FIG. 1, the system 100 has an extraction system 115 and a target system 114 that includes one or more target apparatus 116 having respective target materials (not shown). The target system 114 may be positioned immediately adjacent to or spaced apart from the particle accelerator 102. The target apparatus 116 may be, for example, the target apparatus 200 described in greater detail below. To generate radioisotopes, the particle beam 112 is directed by the particle accelerator 102 through the extraction system 115 along a beam transport path or beam passage 117 and into the target system 114 so that the particle beam 112 is incident upon the target material located at a corresponding production or target chamber 120 within the corresponding target apparatus 116. When the target material is irradiated with the particle beam 112, the target material may generate radioisotopes through nuclear reactions. Thermal energy may also be generated within the target chamber 120.

As shown, the system 100 may have multiple target apparatuses 116A-C with respective target chambers 120A-C where target materials are located. A shifting device or system (not shown) may be used to shift the target chambers 120A-C with respect to the particle beam 112 so that the particle beam 112 is incident upon a different target material for different production sessions. Alternatively, the particle accelerator 102 and the extraction system 115 may not direct the particle beam 112 along only one path, but may direct the particle beam 112 along a unique path for each different target chamber 120A-C. Furthermore, the beam passage 117 may be substantially linear from the particle accelerator 102 to the target chamber 120 or, alternatively, the beam passage 117 may curve or turn at one or more points therealong. For example, magnets (not shown) positioned alongside the beam passage 117 may be configured to redirect the particle beam 112 along a different path.

Examples of isotope production systems and/or cyclotrons having one or more of the sub-systems are described in U.S. Pat. Nos. 6,392,246; 6,417,634; 6,433,495; and 7,122,966 and in U.S. Patent Application Publication Nos. 2005/0283199 and 2012/0321026. Additional examples are also provided in U.S. Pat. Nos. 5,521,469; 6,057,655; 7,466,085; and 7,476,883. Furthermore, isotope production systems and/or cyclotrons that may be used with embodiments described herein are also described in U.S. Patent Application No. 2013/0169194. The target apparatus and methods described herein may be used with these exemplary isotope production systems and/or cyclotrons as well as others.

The system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging applications, the radioisotopes may also be called tracers. By way of example, the system 100 may generate protons to make isotopes in liquid form, such as $^{18}F^-$ isotopes. $^{13}N$ isotopes may also be generated by the system 100. The target material may be a starting liquid used to make these isotopes. The starting liquid may be, for example, enriched water such as $H_2{}^{18}O$ water or $H_2{}^{16}O$.

In some embodiments, the system 100 uses $^1H^-$ technology and brings the charged particles to a low energy (e.g., about 9.6 MeV) with a beam current of approximately 10-1000 μA or, more particularly, approximately 10-500 μA. In particular embodiments, the system 100 uses $^1H^-$ technology and brings the charged particles to a low energy (e.g., about 9.6 MeV) with a beam current of approximately 10-200 μA or, more particularly, approximately 10-70 μA. In such embodiments, the negative hydrogen ions are accelerated and guided through the particle accelerator 102 and into the extraction system 115. The negative hydrogen ions may then hit a stripping foil (not shown in FIG. 1) of the extraction system 115 thereby removing the pair of electrons and making the particle a positive ion, $^1H^+$. However, embodiments described herein may be applicable to other types of particle accelerators and cyclotrons. For example, in alternative embodiments, the charged particles may be positive ions, such as $^1H^+$, $^2H^-$, and $^3He^+$. In such alternative embodiments, the extraction system 115 may include an electrostatic deflector that creates an electric field that guides the particle beam toward the target chamber 120. Furthermore, in other embodiments, the beam current may be, for example, up to approximately 200 μA. The beam current could also be up to approximately 2000 μA or more.

The system 100 may also be configured to accelerate the charged particles to a predetermined energy level. For example, some embodiments described herein accelerate the charged particles to an energy of approximately 18 MeV or less. In other embodiments, the system 100 accelerates the charged particles to an energy of approximately 16.5 MeV or less. However, embodiments describe herein may also have an energy above 16.5 MeV. For example, embodiments may have an energy above 100 MeV, 500 MeV or more.

The system 100 may produce the isotopes in approximate amounts or batches, such as individual doses for use in medical imaging or therapy. Accordingly, isotopes having different levels of activity may be provided.

The system 100 may include a cooling system 122 that transports a cooling or working fluid to various components of the different systems in order to absorb heat generated by the respective components. The system 100 may also include a control system 118 that may be used by a technician to control the operation of the various systems and components. The control system 118 may include one or more user-interfaces that are located proximate to or remotely from the particle accelerator 102 and the target system 114. Although not shown in FIG. 1, the system 100 may also include one or more radiation and/or magnetic shields for the particle accelerator 102 and the target system 114.

Figure 2:
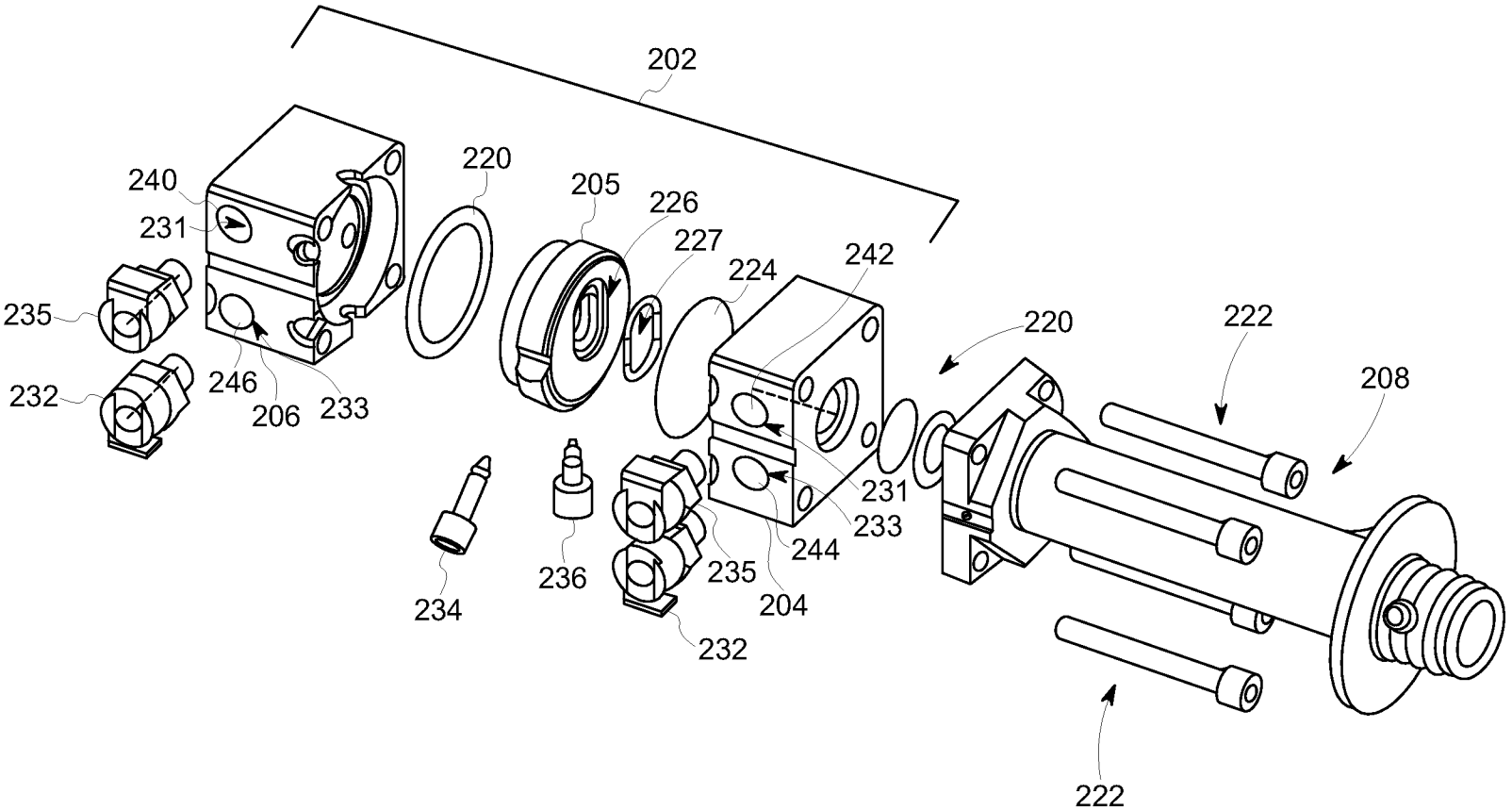
FIG. 2 is an exploded view of a target apparatus formed in accordance with an embodiment.

FIG. 2 is an exploded perspective view of the target apparatus 200 illustrating various components that may be assembled together to form the target apparatus 200. However, the components shown and described herein are only exemplary and the target apparatus may be constructed according to other configurations. For example, some of the components may be combined into a single structure in other embodiments. As shown, the target apparatus 200 includes a beam conduit 208 and a target housing 202 that is configured to be coupled to the beam conduit 208. The beam conduit 208 may enclose a beam passage, such as the beam passage 117 (FIG. 1). As shown, the target housing 202 may include a plurality of housing portions 204-206. The housing portion 204 may be referred to as a leading housing portion that couples to the beam conduit 208, the housing portion 205 may be referred to as a target body, and the housing portion 206 may be referred to as a trailing housing portion. Although not shown, the target apparatus 200 may fluidly couple to a fluidic system that delivers and removes a working fluid(s) for cooling and controlling production of the radioisotopes and also to a fluidic system that delivers and removes the liquid that carries the radioisotopes.

Figure 3:
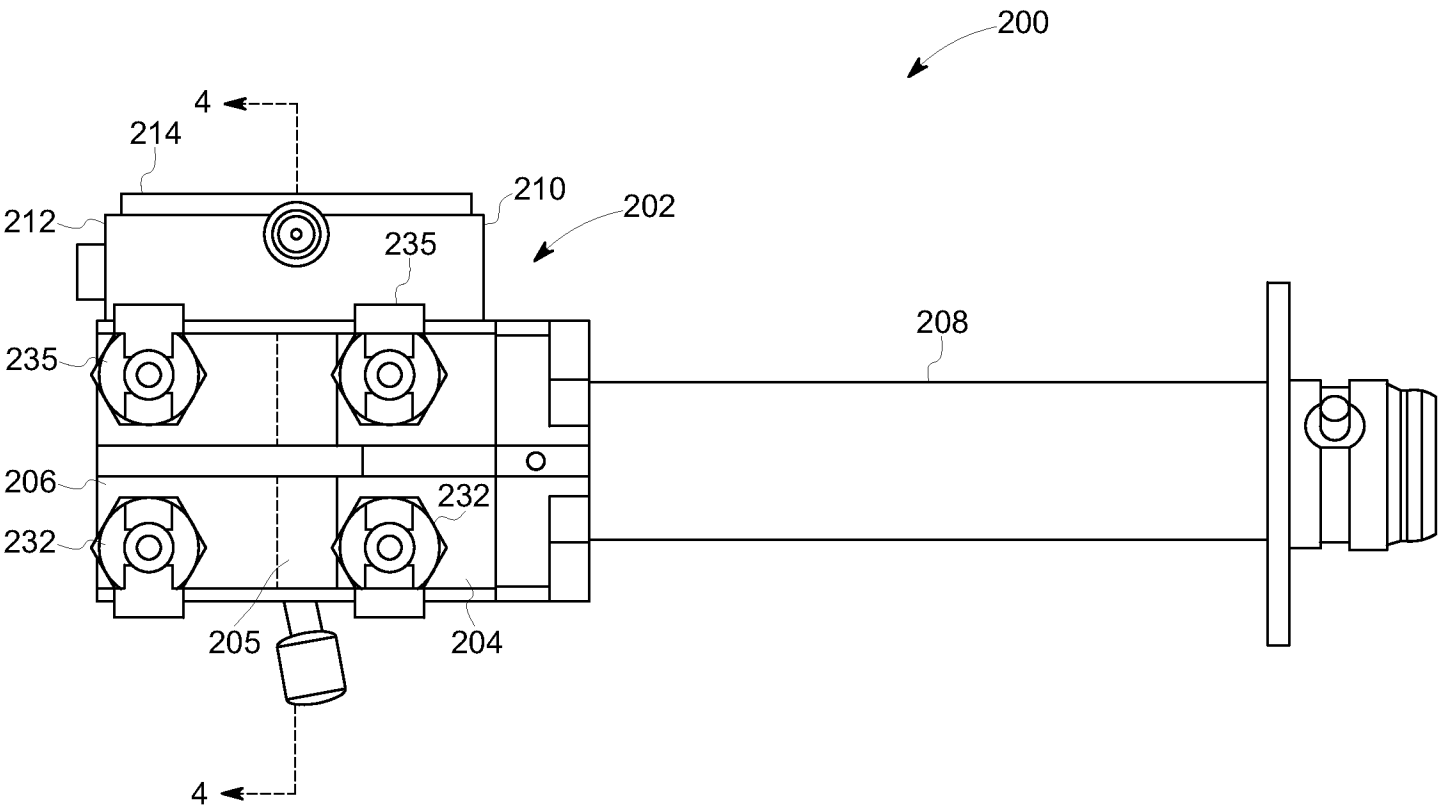
FIG. 3 is a side view of the target apparatus of FIG. 2.

The target apparatus 200 may also include mounting members 210, 212 (FIG. 3) and a cover plate 214 (FIG. 3). The housing portions 204-206, the mounting members 210, 212, and the cover plate 214 may comprise a common material or be fabricated from different materials. For example, the housing portions 204-206, the mounting members 210, 212, and the cover plate 214 may comprise metal or metal alloys that include aluminum, steel, tungsten, nickel, copper, iron, niobium, or the like. In some embodiments, the materials of the various components may be selected based upon the thermal conductivity of the material and/or the ability of the materials to shield radiation. The components may be molded, die-cast, and/or machined to include the operative features disclosed herein such as the various openings, recesses, or passages shown in FIG. 2.

For example, the housing portions 204-206 may include passages 240-246 that extend through the respective components. The target body 205 includes a cavity 226 that may extend entirely through a thickness of the target body 205. In other embodiments, the cavity 226 extends only a limited depth into the target body 205. The cavity 226 may have a window 227 that provides access to the cavity 226. The target apparatus 200 may also include nozzles or valves 235, 232 that are configured to be inserted into respective openings 231, 233 of the housing portions 204 and/or 206. Connections (e.g., nozzle, valve) 234, 236 may also be inserted into respective openings of the target body 205.

The target apparatus 200 can also include a variety of sealing members 220 and fasteners 222. The sealing members 220 are configured to seal interfaces between the components to maintain a predetermined pressure within the target apparatus 200 (e.g., such as the fluid circuit formed by the passages 240-246), to prevent contamination from the ambient environment, and/or to prevent fluid from escaping into the ambient environment. The fasteners 222 may be configured to secure the components of the target apparatus 200 to each other. Also shown, the target apparatus 200 includes at least one cavity cover member 224. The particle beam is configured to be incident upon the cavity cover member 224.

Figure 4:
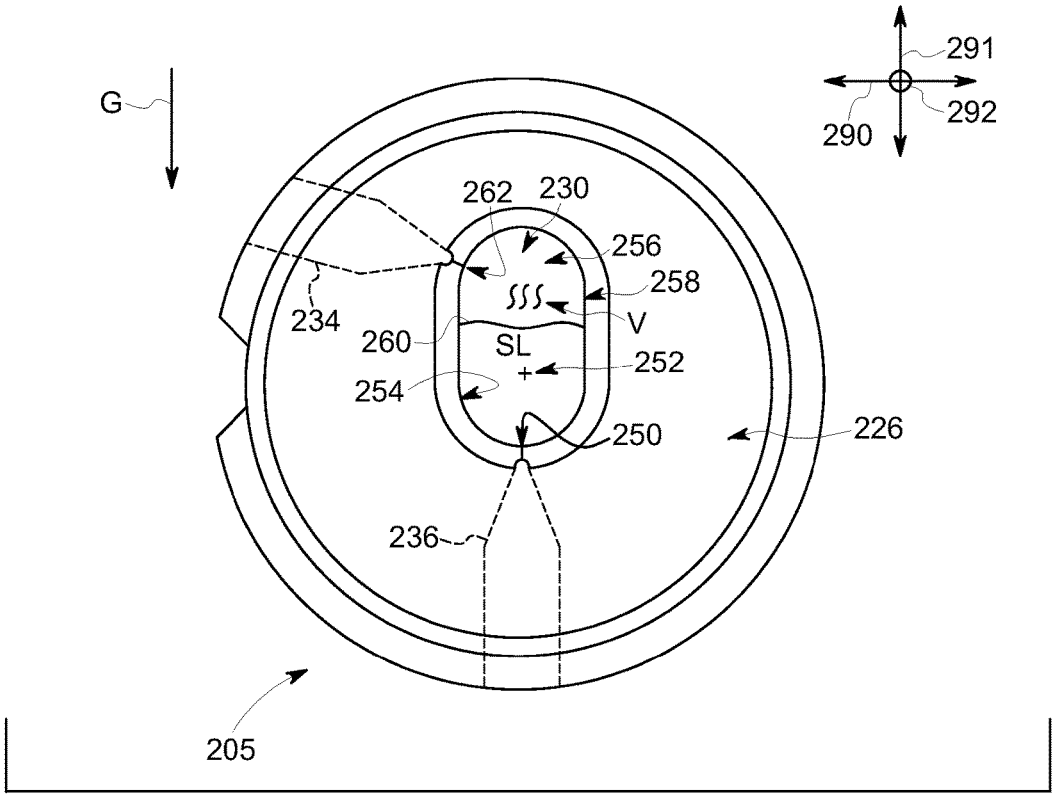
FIG. 4 is a front view of a target chamber, in accordance with an embodiment.

As shown in FIG. 3, when the target apparatus 200 is fully constructed, the target body 205 is sandwiched between the housing portions 204, 206 so that the cavity 226 (FIG. 2) is enclosed with the cavity cover member 224 to form a target chamber 230 (FIG. 4). The beam conduit 208 is secured to the housing portion 204. The beam conduit 208 is configured to receive the particle beam and permit the particle beam to be incident upon the target chamber 230. Also, when the target housing 202 is constructed, the passages 240-246 (FIG. 2) may form a fluid circuit that is a part of the cooling system 122. The passages 240-246 direct a working fluid (e.g., cooling fluid such as water) through the target housing 202 to absorb thermal energy and transfer the thermal energy away from the target housing 202. Incoming fluid may enter through the nozzle 235 and exit through the nozzle 232. In other embodiments, the incoming fluid may enter through the nozzle 232 and exit through the connection 234.

FIG. 4 is a cross-section of the target body 205 taken along the lines 4-4 in FIG. 3. As described above, the target chamber 230 is formed within the target housing 202 (FIG. 2) when the target body 205 is stacked with respect to the housing portions 204 and 206. However, in alternative embodiments, the target chamber 230 may be formed by other methods. The target chamber 230 is disposed within the target housing 202 and is defined by the cavity 226 with an interior surface 254, which is in contact with a starting liquid SL, and an interior surface 258, which defines a head space 256. The cavity 226 may be configured to contain or hold a starting liquid SL and a vapor V (shown as wavy lines), which may be formed within the cavity 226. The starting liquid SL may be injected into the cavity 226 through the connection 236 to a level 260 that has access to the target chamber 230 through the interior surface 254 at a port 250. The level 260 separates the interior surfaces 254 and 258. It should be noted that the level 260 of the starting liquid SL may change during the production session (e.g., during operation of the target apparatus 200). The target chamber 230 is located so that the particle beam may be incident upon the starting liquid SL at a strike point 2523.

The target apparatus 200 may be oriented with respect to axes 290, 291 and 292. In some embodiments, the axis 291 may also be referred to as a gravitational force axis since the axis 291 is aligned with gravity. As indicated by an arrow G, gravity can facilitate pulling liquid within the cavity 226 in one general direction. Also, gas or the vapor V within the cavity 226 may generally rise above the starting liquid SL in a direction that is opposite that of the arrow G.

The target apparatus 200 may also include a gas line (not shown) connected to the connection 234. The connection 234 may constitute or be part of a pressure regulator that regulates the flow of a working gas (e.g., helium) into and out of a head space 256 of the target chamber 230 received by the gas line through a port 262. The working gas may be configured to raise and/or lower the boiling temperature of the starting liquid SL.

During operation of the target apparatus 200, the particle beam is incident upon the starting liquid SL at the strike point 252. The particle beam may be constantly or intermittently applied to the starting liquid SL during a production session. When the particle beam is incident upon the starting liquid SL, radioisotopes are generated within the starting liquid SL. Thermal energy (e.g., heat) is also deposited within the starting liquid SL. The increased amount of heat may cause at least a portion of the starting liquid SL to transform into the vapor V. As the vapor V is generated within the target chamber 230, the pressure within the production chamber 230 increases. As such, the vapor V is forced into the head space 256.

As the vapor V is within the head space 256, the vapor V becomes in contact with the interior surface 258. The cavity 226 comprises a body material that is thermally conductive. In other words, the body material is configured to absorb thermal energy generated within the cavity 226 and permit the thermal energy to transfer away from the cavity 226. In an exemplary embodiment, the target apparatus 200 is configured to remove thermal energy away from the interior surface 258 to facilitate transformation of possible vapor V into a condensed liquid, which returns to the starting liquid. For example, the passages 240 and 246 are located adjacent or thermally coupled to an external surface 502 (FIG. 5) of the cavity 226 and extend in a perpendicular manner with respect to the axes 290, 291 and 292. Optionally, the passages 240 and 246 may be coupled to a portion of the external surface 502 that corresponds to a surface area represented by the interior surface 258. A working fluid (e.g., gas or liquid, such as water) is configured to flow through the passages 240 and 246. The flow rate of the working fluid may be a part of and controlled by the cooling system 122. The working fluid may absorb thermal energy from the cavity 226 and transfer the thermal energy away from the target body 205 thereby reducing the heat experienced by the interior surface 258. In at least one embodiment, a heat sink having fins may be located adjacent or thermally coupled to the external surface 502 of the cavity 226 or within the passages 240, 246. A working fluid may flow through the fins of the heat sink to remove thermal energy. Accordingly, some embodiments may include an active cooling mechanism that actively cools the cavity 226. Optionally, the target housing 202 may include a condensing chamber and a fluid channel that are also disposed within the target housing 202 as described in U.S. Patent Publication 2012/0321026, titled "TARGET APPARATUS AND ISOTOPE PRODUCTION SYSTEM AND METHODS USING THE SAME," which is hereby expressly incorporated herein by reference in its entirety.

Figure 5:
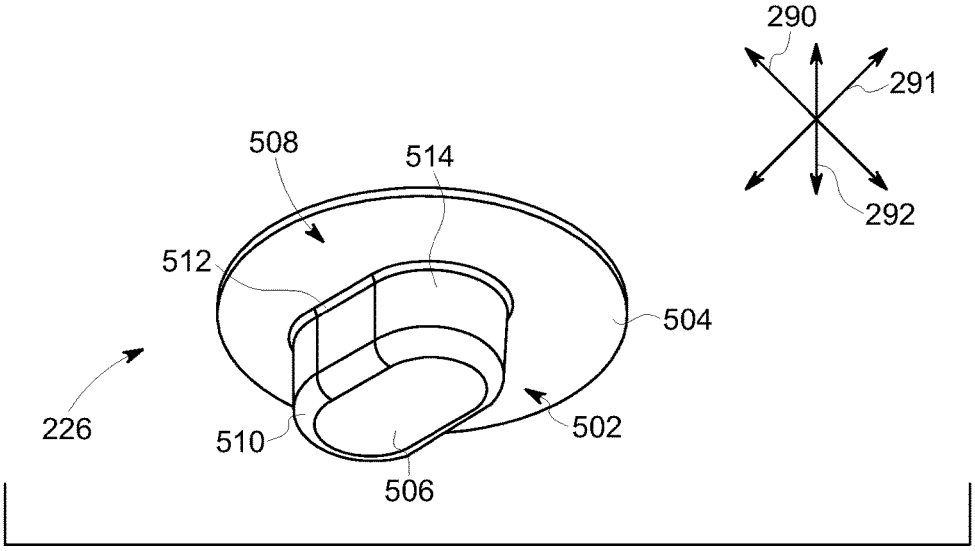
FIG. 5 is a peripheral view of a cavity for a target chamber, in accordance with an embodiment.
Figure 6:
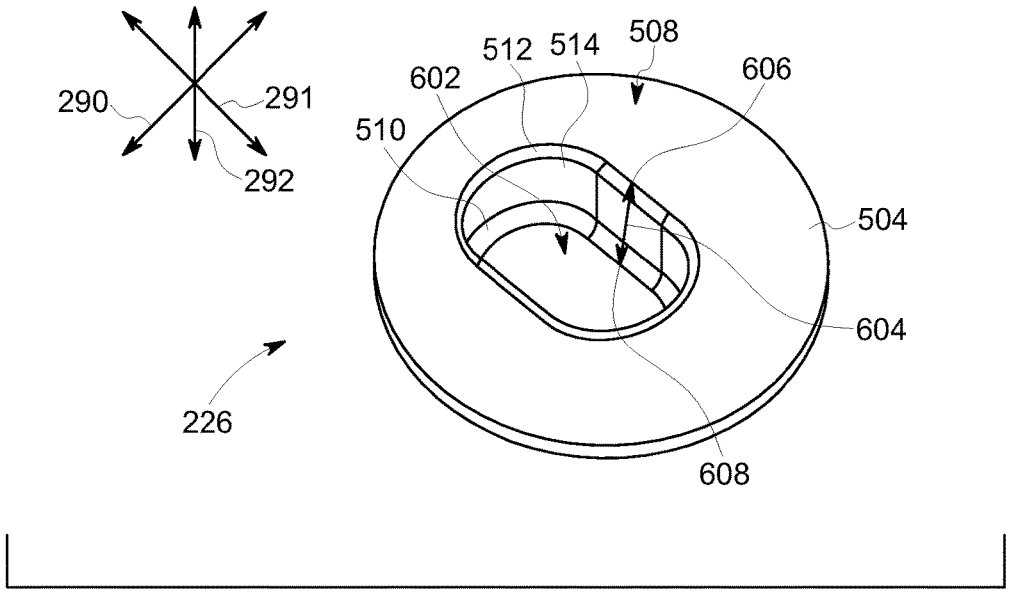
FIG. 6 is another peripheral view of the cavity in FIG. 4.

FIGS. 5-6 are peripheral views of the cavity 226 from the target chamber 230 shown in FIG. 4. FIG. 5 is a peripheral view of a base 506 of the cavity 226 shown concurrently with the axes 290, 291 and 292 of FIG. 4. The cavity 226 is formed from a single sheet 504 of a metal foil by mechanically punching, hydroforming (e.g., using pressurized water), hydraulic forming (e.g., using pressurized oil or other fluids), or the like, a cavity form into the metal foil. The metal foil may comprise a metal and/or metal alloy that includes at least one of niobium, tantalum, aluminum or stainless steel, and have a thickness 702 (FIG. 7) of zero point five millimeters. It should be noted that the thickness 702 of the metal foil may be greater than or less than zero point five millimeters. For example, the thickness 702 of the metal foil may be in a range of one to five millimeters.

The external surface 502 of the cavity 226 is shown having curved edges 510, 512. Each curved edge 510, 512 is interposed between sections of the cavity 226 (e.g., the base 506, a lip 508, a transition section 514) that may be aligned with one of the axes 290, 291 and 292. The sections of the cavity 226 may correspond to one or more structural features of the cavity 226, such as, the transition section 514 that may correspond to a depth 604 (FIG. 6) of the cavity 226. Each curved edge 510, 512 may be configured to transition a corresponding section of the cavity 226 to another section. For example, the curved edge 512 is interposed between the lip 508, which is aligned with the axis 291, and the transition section 514, which is perpendicular to the lip 508 and aligned with the axis 292. The curved edge 510 is interposed between the transition section 514 and the base 506.

FIG. 6 is a peripheral view of an interior surface 602 of the cavity 226 shown concurrently with the axes 290, 291 and 292 of FIG. 4. A difference in the positions of the lip 508 and the base 506 along the axis 292 creates an upper 606 and lower 608 limits of the interior surface 602 of the cavity 226 defining the depth 604 of the cavity 226. In at least one embodiment, the depth 604 of the cavity 226 may be ten millimeters. It should be noted that in other embodiments the depth 604 may be greater than or less than ten millimeters. For example, the depth 604 of the cavity 226 may be in a range of one to twenty-five millimeters (e.g., in at least one embodiment the depth 604 is one millimeter, in at least one embodiment the depth 604 is twenty-five millimeters). It should be noted in other embodiments, the depth 604 may be greater than twenty-five millimeters. The interior surface 602 is bounded laterally by the transition section 514 allowing the cavity 226 to contain the starting liquid SL. The interior surface 602 is shown having an elliptical shape. In other embodiments, the interior surface 602 may have other shapes that do not include corners (e.g., two converging surfaces meet at an angle), such as, an oval, a circle, or other shapes. Additionally or alternatively, the interior surface 602 may include shapes that have corners, such as, a rectangle, a square, a triangle, or the like.

In at least one embodiment, the interior surface 602 of the cavity 226 is enclosed by the cavity cover member 224 (FIG. 2). The cover member 224 may be coupled to the lip 508. Optionally, the cover member 224 may comprise the same metal as the single sheet 504.

Figure 7:
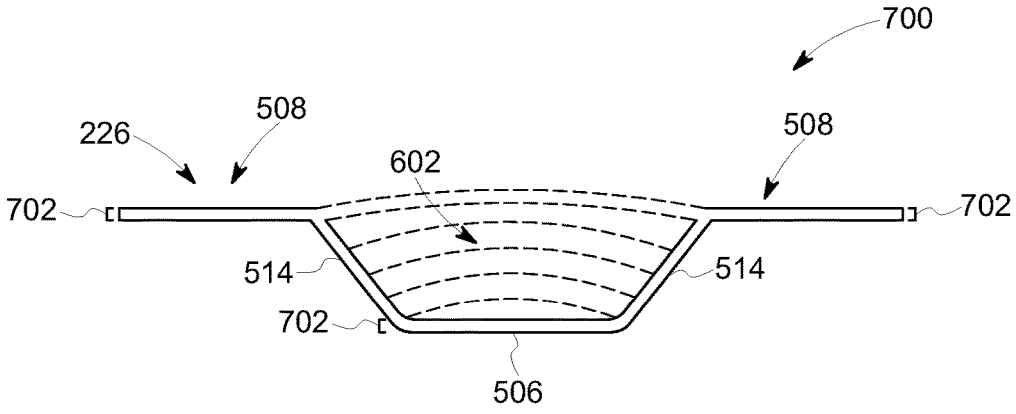
FIG. 7 is a cross section of the cavity in FIG. 4.

FIG. 7 illustrates a cross section 700 (FIG. 7) of the cavity 226 along the axis 291. The cross section 700 shows the thickness 702 of the single sheet 504 of metal foil that is formed into the cavity 226. Optionally, the thickness 702 of the single sheet 504 may be in a range of one to five millimeters. (e.g., in at least one embodiment the thickness 702 may be one millimeter, and at least one embodiment the thickness 702 may be five millimeters). It should be noted in other embodiments the thickness 705 may be less than one millimeter (e.g., zero point five millimeters) or greater than five millimeters. Additionally or alternatively, the thickness 702 of the single sheet 504 may be uniform throughout the cavity 226, for example, the thickness 702 is approximately (e.g., within a predetermined tolerance) the same throughout the cavity 226. For example, the transition section 514, the base 506, the lip 508 and the curved edges 510 and 512 may have approximately the same thickness 702 within the predetermined tolerance.

Figure 8:
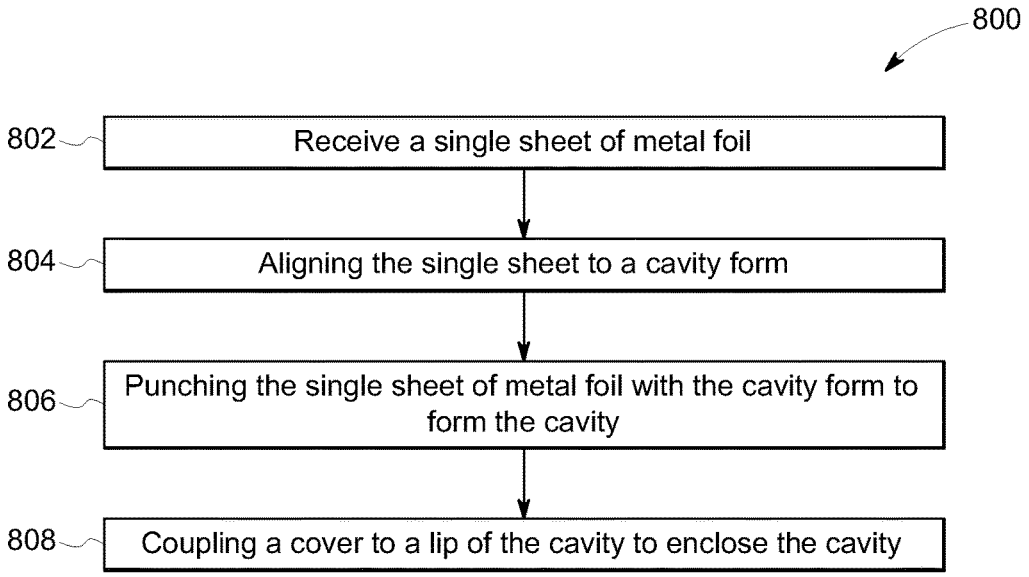
FIG. 8 is a flow chart of a method for manufacturing a target chamber, in accordance with an embodiment.

FIG. 8 illustrates a flowchart of a method 800 for manufacturing a target chamber. The method 800, for example, may employ structures or aspects of various embodiments (e.g., systems and/or methods) discussed herein. In various embodiments, certain steps (or operations) may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion. In various embodiments, portions, aspects, and/or variations of the method 800 may be used as one or more algorithms to direct hardware to perform one or more operations described herein. It should be noted, other methods may be used, in accordance with embodiments herein.

One or more methods may (i) receiving a single sheet of metal foil; (ii) punching the single sheet of metal foil to form a cavity, and (iii) coupling a cover to a lip of the cavity to enclose the cavity.

Beginning at 802, the method 800 receives the single sheet 504 of metal foil. The single sheet 504 of metal foil may be a metal and/or metal alloy that comprises niobium, tantalum, aluminum, stainless steel, or the like. The single sheet 504 of metal foil may have a thickness (e.g., thickness 702) in a range between one to five millimeters. For example the single sheet 504 of metal foil may have a thickness of one millimeter. It should be noted, the thickness of the metal foil may be less than one millimeter (e.g., zero point five millimeters) or greater than five millimeters.

At 804, the single sheet 504 may be aligned to a cavity form. The cavity form may include a template of the features (e.g., the lip 508, the transition section 514, the base 506, the curved edges 510 and 512, of the like) of the cavity 226. The cavity form may be configured to define a depth (e.g., the depth 604) of the cavity 226 when compressed with a sheet of metal (e.g., the single sheet 504).

At 806, punching the single sheet 504 of metal foil with the cavity form to form the cavity 226. For example, once the single sheet 504 is aligned to the cavity form, high pressure fluid may be used to compress the single sheet 504 to the cavity form to form the cavity 226. Additionally or alternatively, the punching operation may be performed by mechanically compressing the cavity form to the single sheet 504. Optionally, the punching operation may be a form of hydroforming, hydraulic forming, flex-forming, or the like At 808, a cover (e.g., the cover member 224) is coupled to the cavity 226 to enclose the cavity 226. For example, the cover member 224 may be coupled to the lip 508 of the cavity 226 as shown in FIG. 2.

Optionally, the method 800 may include coupling the cooling system 122 to the cavity 226. For example, the passages 240 and 246 may be a part of the cooling system 122. The passages 240 and 246 may be coupled to the external surface 502 of the cavity 226 having a working fluid (e.g., gas or liquid, such as water) flowing through the passages 240 and 246 to absorb thermal energy from the cavity 226.

It should be noted that the particular arrangement of components (e.g., the number, types, placement, or the like) of the illustrated embodiments may be modified in various alternate embodiments. For example, in various embodiments, different numbers of a given module or unit may be employed, a different type or types of a given module or unit may be employed, a number of modules or units (or aspects thereof) may be combined, a given module or unit may be divided into plural modules (or sub-modules) or units (or sub-units), one or more aspects of one or more modules may be shared between modules, a given module or unit may be added, or a given module or unit may be omitted.

As used herein, a structure, limitation, or element that is "configured to" perform a task or operation may be particularly structurally formed, constructed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, and denotes structural requirements of any structure, limitation, or element that is described as being "configured to" perform the task or operation. For example, a processing unit, processor, or computer that is "configured to" perform a task or operation may be understood as being particularly structured to perform the task or operation (e.g., having one or more programs or instructions stored thereon or used in conjunction therewith tailored or intended to perform the task or operation, and/or having an arrangement of processing circuitry tailored or intended to perform the task or operation). For the purposes of clarity and the avoidance of doubt, a general purpose computer (which may become "configured to" perform the task or operation if appropriately programmed) is not "configured to" perform a task or operation unless or until specifically programmed or structurally modified to perform the task or operation.

It should be noted that the various embodiments may be implemented in hardware, software or a combination thereof. The various embodiments and/or components, for example, the modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a solid state drive, optic drive, and the like. The storage device may also be other similar means for loading computer programs or other instructions into the computer or processor.

As used herein, the term "computer," "controller," and "system" may each include any processor-based or microprocessor-based system including systems using microcontrollers, reduced instruction set computers (RISC), application specific integrated circuits (ASICs), logic circuits, GPUs, FPGAs, and any other circuit or processor capable of executing the functions described herein. The above examples are exemplary only, and are thus not intended to limit in any way the definition and/or meaning of the term "module" or "computer."

The computer, module, or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer, module, or processor as a processing machine to perform specific operations such as the methods and processes of the various embodiments described and/or illustrated herein. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be stand alone programs, may be incorporated as subroutines in an operating system, may be functions in an installed software package, or the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A target housing for a radioisotope production system, the target chamber comprising:

a target body to be held in at least one housing portion that is configured to be aligned with a particle accelerator of the radioisotope production system;

a single sheet of metal foil provided on the target body and shaped to form a cavity having planar sections that include a lip, a base, and a transition section interposed between the lip and the base;

a cover positioned to enclose the cavity, wherein the cover is configured to allow a particle beam from the particle accelerator to pass there through;

a first connection provided at a first port through an interior surface of the cavity, the first connection and first port configured to receive a starting liquid into the cavity, the particle beam to be incident upon the starting liquid thereby generating radioisotopes; and a second connection provided at a second port through the interior surface of the cavity, the second connection and second port configured to regulate pressure within the cavity and a corresponding boiling temperature of the starting liquid.

2. The target housing for a radioisotope production system of claim 1, wherein the single sheet of metal foil comprises at least one of niobium, tantalum, aluminum or stainless steel.

3. The target housing for a radioisotope production system of claim 1, wherein a thickness of the single sheet of metal foil is in a range of 1 to 5 mm thick.

4. The target housing for a radioisotope production system of claim 1, wherein the interior surface of the cavity has an elliptical shape, an oval shape, or a circular shape.

5. The target housing for a radioisotope production system of claim 1, wherein the transition section corresponds to a depth of the cavity, the depth in a range of 1 to 25 mm.

6. The target housing for a radioisotope production system of claim 1, wherein the lip is coupled to the cover.

7. The target housing for a radioisotope production system of claim 1, wherein the cavity is shaped by mechanically punching, hydroforming or hydraulic forming a cavity form factor into the single sheet of metal foil.

8. The target housing for a radioisotope production system of claim 1, further comprising a cooling system coupled externally to the cavity, the cooling system configured to absorb thermal energy and transfer thermal energy away from the cavity.

9. The target housing for a radioisotope production system of claim 1, wherein to regulate pressure is further based on a flow of a working gas through the second port.

10. The target housing for a radioisotope production system of claim 1, wherein the at least one housing portion is secured to a beam conduit that is configured to receive the particle beam and permit the particle beam to be incident upon the cavity.

11. The target housing for a radioisotope production system of claim 1, wherein the second connection and second port increase or decrease the boiling temperature of the starting liquid.

12. An isotope production system comprising:

a particle accelerator configured to produce a particle beam;

a single sheet of metal foil provided on a target body and shaped to form a cavity having planar sections that include a lip, a base, and a transition section interposed between the lip and the base;

a cover positioned to enclose the cavity, wherein the cover is configured to allow the particle beam from the particle accelerator to pass there through;

a first connection provided at a first port through an interior surface of the cavity, the first connection and first port configured to receive a starting liquid, the particle beam to be incident upon the starting liquid thereby generating radioisotopes; and a second connection provided at a second port through the interior surface of the cavity, the second connection and second port configured to regulate pressure within the cavity and a corresponding boiling temperature of the starting liquid.

13. The isotope production system of claim 12, wherein the single sheet of metal foil comprises at least one of niobium, tantalum, aluminum or stainless steel.

14. The isotope production system of claim 12, wherein a thickness of the single sheet of metal foil is in a range of 1 to 5 mm thick.

15. The isotope production system of claim 12, wherein the interior surface of the cavity has an elliptical shape, an oval shape, or a circular shape.

16. The isotope production system of claim 12, wherein the transition section corresponds to a depth of the cavity, the depth in a range of 1 to 25 mm.

17. Housing portions for a radioisotope production system comprising:

a target body to be held in between first and second housing portions that is configured to be aligned with a particle accelerator of the radioisotope production system;

a single sheet of metal foil provided on the target body and shaped to form a cavity having planar sections that include a lip, a base, and a transition section interposed between the lip and the base;

a cover positioned to enclose the cavity, wherein the cover is configured to allow a particle beam from the particle accelerator to pass there through;

a first connection provided at a first port through an interior surface of the cavity, the first connection and first port configured to receive a starting liquid into the cavity through the first or second housing portions, the particle beam to be incident upon the starting liquid thereby generating radioisotopes; and a second connection provided at a second port through the interior surface of the cavity, the second connection and second port configured to regulate pressure within the cavity through the first or second housing portions and a corresponding boiling temperature of the starting liquid.

18. The housing portions of claim 17, wherein to regulate pressure is further based on a flow of a working gas through the second port.

19. The housing portions of claim 17, wherein the first and second housing portions are secured to a beam conduit that is configured to receive the particle beam and permit the particle beam to be incident upon the cavity.

20. The housing portions of claim 17, wherein the second connection and second port increase or decrease the boiling temperature of the starting liquid.

* * * * *